US008997306B2

(12) United States Patent
Hill et al.

(10) Patent No.: US 8,997,306 B2
(45) Date of Patent: Apr. 7, 2015

(54) FLOOR CLEANING MACHINE

(75) Inventors: Jason E. Hill, University City, MO (US); Timothy J. Wall, Plano, TX (US); Steven A. Wahl, Fort Wayne, IN (US); Schubert Pereira, Chesterfield, MO (US); Benjamin J. Heath, Arnold, MO (US); David James Gennrich, Fitchburg, WI (US); Randall Scott Koplin, Sun Prairie, WI (US); Felix Rodriguez Perfino, Cuautitlan Izcalli (MX)

(73) Assignee: Rug Doctor, LLC, Plano, TX (US)

( * ) Notice: Subject to any disclaimer, the term of this patent is extended or adjusted under 35 U.S.C. 154(b) by 540 days.

(21) Appl. No.: 13/326,699

(22) Filed: Dec. 15, 2011

(65) Prior Publication Data

US 2012/0317746 A1 Dec. 20, 2012

Related U.S. Application Data

(60) Provisional application No. 61/423,472, filed on Dec. 15, 2010.

(51) Int. Cl.

| | |
|---|---|
| ***A47L 7/00*** | (2006.01) |
| ***A47L 5/00*** | (2006.01) |
| ***A47L 11/34*** | (2006.01) |
| ***A47L 11/30*** | (2006.01) |
| ***A47L 11/28*** | (2006.01) |

(52) U.S. Cl.

CPC ..... *A47L 11/34* (2013.01); *A47L 11/302* (2013.01); *A47L 11/28* (2013.01)

(58) Field of Classification Search

USPC ..... 15/320, 321, 322, 353, 371, 380, 381, 15/382, 383, 364, 367, 373

See application file for complete search history.

(56) References Cited

U.S. PATENT DOCUMENTS

| | | | | |
|---|---|---|---|---|
| 4,014,067 | A | 3/1977 | Bates | |
| 4,136,420 | A | 1/1979 | Cyphert et al. | |
| 4,720,891 | A | 1/1988 | Rennecker et al. | |
| 5,473,792 | A | 12/1995 | Kent et al. | |
| 6,789,290 | B2 | 9/2004 | Kent et al. | |
| 7,048,805 | B2 | 5/2006 | Kent et al. | |
| 7,178,196 | B2 * | 2/2007 | Morgan et al. | 15/320 |
| 2005/0160553 | A1 | 7/2005 | Gregory | |

FOREIGN PATENT DOCUMENTS

| | | | |
|---|---|---|---|
| GB | 707366 | A | 4/1954 |

* cited by examiner

*Primary Examiner* — Robert Scruggs

(74) *Attorney, Agent, or Firm* — Thompson Coburn LLP

(57) ABSTRACT

A floor cleaning machine has a housing and a movable hood that covers over vacuum and liquid hoses of the machine that are visible in prior art floor cleaning machines. The vacuum and liquid hoses are each pivotally connected to a wall of the machine housing and are also pivotally connected to a transparent dome provided on the hood. These connections reduce stresses on the hoses when the hood is moved and allow the dome to pivot relative to the hood. The floor cleaning machine also has a pair of slit orifices that eject fan spray patterns of cleaning liquid that are non-coplanar and do not intersect each other. Furthermore, the floor cleaning machine has an oscillating brush assembly that includes a brush that is replaceable without using tools. The brush height can be adjusted via an adjustment member provided on the oscillating portion of the assembly.

5 Claims, 12 Drawing Sheets

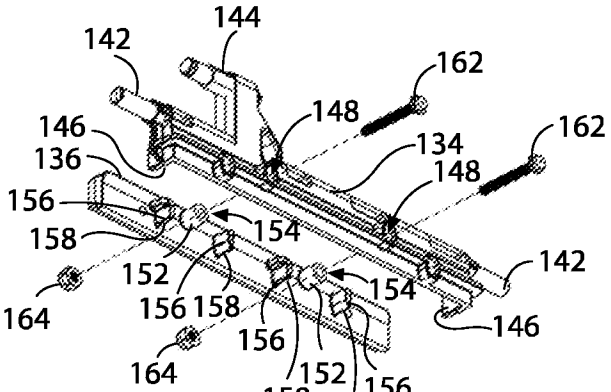
FIG. 16
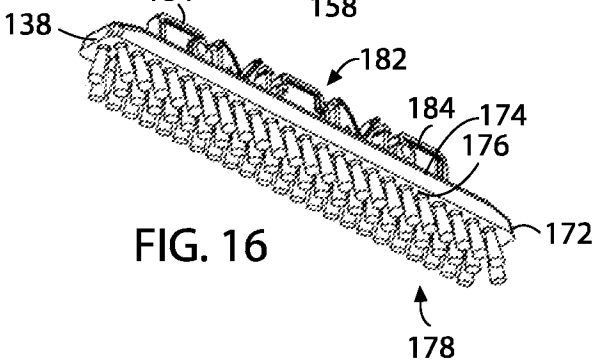
FIG. 15
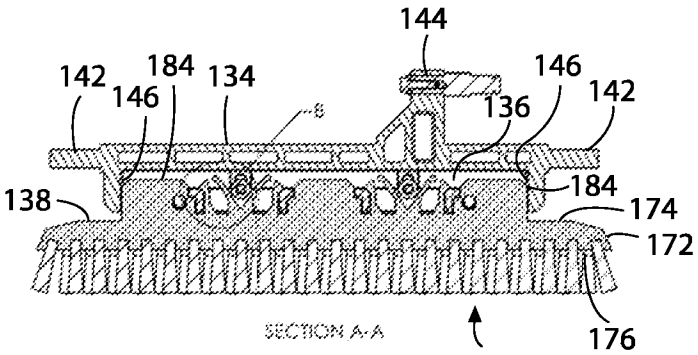
FIG. 13
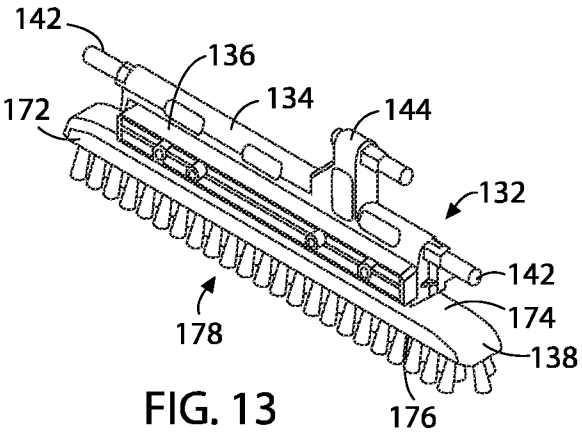
FIG. 14
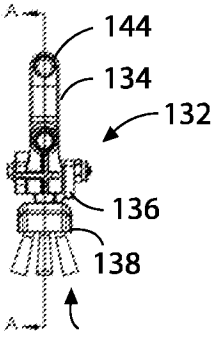
FIG. 17
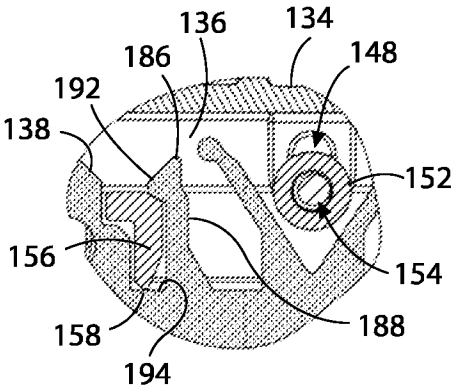

FLOOR CLEANING MACHINE

CROSS-REFERENCE TO RELATED APPLICATIONS

This application claims priority to U.S. Provisional Patent App. No. 61/423,472, filed on Dec. 15, 2010.

BACKGROUND OF THE INVENTION

1. Field of the Invention

The present invention is directed to a floor cleaning machine that is manually moved over the floor surface to be cleaned. More specifically, the present invention is directed to a floor cleaning machine having a housing with an aesthetically pleasing appearance. The housing includes a movable hood that covers over a vacuum hose and a liquid hose of the machine that are visible in prior art floor cleaning machines. The vacuum hose and liquid hose are each connected by a ball and socket connection to a wall of the machine housing, and are connected by pivoting connections to a transparent dome on the housing hood. These connections reduce stresses on the hoses when the hood is moved. Additionally, the floor cleaning machine has a pair of spray tips, each having a slit orifice that ejects a fan spray pattern of cleaning liquid. The spray tips are in spaced positions on the bottom of the machine where the slit orifices of the spray tips are parallel to each other but are not coplanar. This prevents the fan spray patterns from the two spray tips from interfering with each other. Furthermore, the floor cleaning machine of the invention has an oscillating brush assembly that includes a brush that is manually removable and replaceable on the brush assembly without using tools, and where the brush height relative to the machine can be adjusted on the brush assembly.

2. Description of the Related Art

The typical prior art floor cleaning or carpet cleaning machine has an exterior appearance that is dictated by the functional features of the machine. Examples of prior art floor cleaning machines are disclosed in the Kent et al. U.S. Pat. No. 6,789,290 and the Kent et al. U.S. Pat. No. 7,048,805. These patents are assigned to the assignee of this application and are incorporated herein by reference.

Basically, the typical prior art floor cleaning machine includes a housing that contains a liquid pump and pump motor, a vacuum pump and pump motor, and the related electronics of the machine. A cleaning liquid storage tank is supported on the housing and a liquid recovery tank is supported on the housing.

In the prior art cleaning machines disclosed in the above-referenced patents, a transparent dome is provided over a top opening of the liquid recovery tank. The dome is held in place by a bale or handle of the recovery tank. The handle can be moved to a position over the dome where the handle holds the dome to the top of the recovery tank, and a position displaced from the dome where the dome can be removed from the top of the recovery tank and the liquid recovery tank can be removed from the machine for emptying the recovery tank.

A vacuum hose is connected to one side of the transparent dome. A liquid hose that communicates with a suction nozzle on the bottom of the machine is connected to the opposite side of the transparent dome. Both of the hoses are visible on the exterior of the machine, detracting from the aesthetic appearance of the machine. The connections of the ends of the vacuum hose and the liquid hose to the opposite sides of the dome are fixed connections. When the dome is removed from the top of the liquid recovery tank for emptying the recovery tank, the degree of movement of the dome is limited by the flexibility of the two hoses. This makes it inconvenient for the user of the machine to remove the dome from the top of the liquid recovery tank and move the dome to a position where there is sufficient clearance to remove the liquid recovery tank from the machine housing and then replace the liquid recovery tank on the machine housing.

One or more spray tips are provided on the bottom of the housing for ejecting the cleaning liquid onto the floor surface being cleaned. The liquid spray pattern from the spray tips of the conventional floor cleaning machine is a fan spray pattern. With two spray tips positioned side by side such as those disclosed in the above-referenced patents, the fan spray pattern from the two spray tips intersect each other so that there are no gaps between the spray contact with the area of the floor being cleaned. However, the intersection of the two fan spray patterns of the spray tips forms larger droplets of the cleaning liquid in the area of the intersection. This results in a disproportionate amount of cleaning liquid being sprayed onto the floor surface being cleaned in the area of the intersection of the spray patterns.

A brush assembly having a rotating brush or an oscillating brush is positioned on the bottom of the machine housing to scrub the cleaning liquid ejected by the spray tips into the floor surface being cleaned. The brush is attached to the bottom of the machine by mechanical fasteners and cannot be removed without the use of tools. This makes removing a worn brush for replacement by a new brush, or a replacement of one type of surface cleaning brush with another type of surface cleaning brush problematic. In addition, in prior art machines such as those disclosed in the above-referenced patents, the height of the brush bristles relative to the machine is not adjustable.

SUMMARY OF THE INVENTION

The floor cleaning machine of the present invention overcomes the above-described disadvantages of prior art floor cleaning machines.

Like prior art floor cleaning machines, the floor cleaning machine of the invention has an exterior housing that is supported on a pair of wheels at the bottom of the housing. A manual handle is connected to the back of the housing. The floor cleaning machine can be manually moved on the pair of wheels over a floor surface to be cleaned by manually pushing and pulling the handle. The housing of the machine has a liquid storage tank, a liquid recovery tank, a transparent dome positioned on top of the liquid recovery tank, and a vacuum hose and liquid hose communicating with the opposite sides of the transparent dome, as do prior art cleaning machines.

However, the exterior surface of the machine housing of the invention has a sleek design configuration that gives the machine a more aesthetically pleasing appearance than prior art machines. The machine housing has a movable hood that provides part of the sleek exterior appearance of the housing. The hood covers over the vacuum hose and liquid hose that detract from the aesthetic appearance of prior art machines.

The hood has an opening and the transparent dome is connected to the hood and extends through the opening. This allows the transparent dome to be viewed from the exterior of the machine when the hood is closed over the vacuum hose and liquid hose. The hood is connected to the machine housing by a pivoting connection that allows the hood to move from an at rest position on the housing where the hood extends over the vacuum hose and liquid hose connected to the dome, to a displaced position of the hood on the housing where the hood and the transparent dome connected to the hood are raised above the liquid recovery tank, allowing the liquid recovery tank to be easily removed from the housing and replaced back on the housing.

The vacuum hose and the liquid hose are connected by pivot connections to the opposite sides of the dome. This allows the dome to pivot relative to the vacuum hose and the liquid hose as the dome is positioned on top of the liquid recovery tank. This allows a bottom edge of the dome to engage in a sealing engagement with the top of the liquid recovery tank. The pivot connections of the vacuum hose and the liquid hose are secured or fixed to the interior surface of the hood, positioning the dome in the opening through the hood. This causes the dome to move with the hood when the hood is moved between its at rest position over the liquid recovery tank to its displaced position away from the liquid recovery tank.

The opposite ends of the vacuum hose and the liquid hose from their connections to the dome are connected to a wall of the machine housing by ball and socket connections. The ball and socket connections provide more freedom of movement to the vacuum hose and liquid hose as the hood is moved than is provided by the flexibility of the hoses alone. This reduces the stresses on the hoses as the hood is moved between its at rest position and its displaced position.

The floor cleaning machine of the invention also has a pair of spray tips that have slit orifices that eject a fan spray pattern of cleaning liquid from the spray tips. The spray tips are positioned at staggered positions on the bottom of the cleaning machine where the slit orifices of the two spray tips are positioned in parallel but not coplanar planes. This allows the fan spray patterns of the two spray tips to overlap each other without intersecting and interfering with each other.

The cleaning machine of the invention is also provided with an oscillating brush assembly on the bottom of the machine. The brush assembly includes a brush that can be easily manually removed from the assembly and replaced on the assembly without the use of tools. In addition, the brush assembly enables the brush to be adjustably positioned relative to the cleaning machine housing.

The above novel features of the floor cleaning machine of the invention overcome each of the disadvantages of prior art cleaning machines identified earlier. Each of the described novel features of the floor cleaning machine of the invention make the machine more easily usable than prior art carpet cleaning machines. In addition, the above-described construction of the floor cleaning machine of the invention has a more aesthetically pleasing exterior appearance than prior art cleaning machines.

BRIEF DESCRIPTION OF THE DRAWINGS

Further features of the invention are set forth in the following detailed description of the floor cleaning machine and in the drawing figures.

FIG. 13 is a perspective view of the brush assembly of the machine disassembled from the machine.

FIG. 14 is a side elevation view of the brush assembly shown in FIG. 13.

FIG. 15 is a cross-section view of the brush assembly along the line A-A of FIG. 14.

FIG. 16 is a perspective view of the brush assembly showing the component parts of the brush assembly disassembled.

FIG. 17 is a partial, cross-section view of component parts of the brush assembly.

DETAILED DESCRIPTION OF THE FLOOR CLEANING MACHINE

Figure 12:
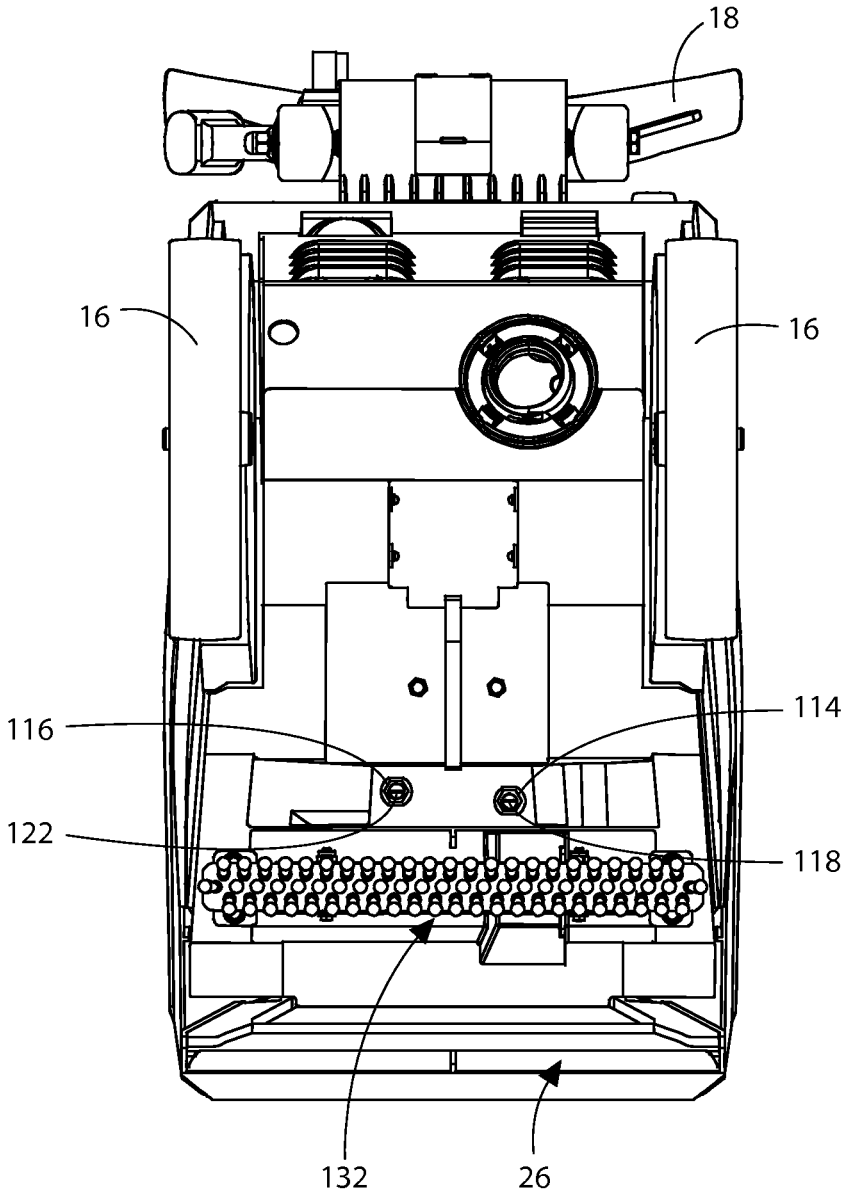
FIG. 12 is a bottom plan view of the machine.

The exterior appearance of a preferred embodiment of a floor cleaning machine 12 in accordance with the invention is shown in FIGS. 1-8, with the bottom of the machine being shown in FIG. 12. Many of the component parts of the machine 12 are substantially functionally the same as those of prior art machines and are constructed of substantially the same materials and in substantially the same way as prior art machines. Therefore, these component parts will not be described in detail herein. Like prior art floor cleaning machines, the floor cleaning machine 12 has an exterior housing 14 that is supported on a pair of wheels 16 at the bottom of the housing. A manual handle 18 is connected to the back of the housing. By manually gripping the handle 18 and tilting the machine rearwardly to position the machine on its wheels 16, the cleaning machine 12 can be moved over a floor surface to be cleaned by manually pushing and pulling the handle 18. Although not necessary, the cleaning machine 12 could include some form of self or assisted propulsion system that drives the wheels to facilitate movement of the cleaning machine 12. In such a case however, the handle would still be used to manually control the movement of the cleaning device 12.

The machine housing 14 has a cleaning liquid storage tank 22 that stores a premixed solution of cleaning liquid and water. The cleaning liquid is pumped to spray tips of the machine and sprayed on a floor surface to be cleaned by the machine. Brushes are provided on the bottom of the machine for scrubbing the cleaning liquid into the floor surface.

A suction nozzle 26 is provided at the bottom of the machine for vacuuming up the cleaning liquid which is then delivered to a liquid recovery tank 28 on the machine housing.

A transparent dome 32 is provided that is positioned over a top opening of the liquid recovery tank 28 for viewing the used cleaning liquid vacuumed from the floor surface and delivered to the liquid recovery tank 28. A vacuum pressure hose 34 communicates with one side of the transparent dome 32 and delivers vacuum pressure from a pump of the machine to the interior of the dome 32. The vacuum pressure hose has a flexible length with opposite first 34*a* and second 34*b* ends. A liquid recovery hose 36 communicates with the opposite side of the dome 32 and also communicates with the suction nozzle 26 of the machine. The liquid hose 36 has a flexible length with opposite first 36*a* and second 36*b* ends. The vacuum pressure delivered to the dome 32 is transmitted through the liquid hose 36 to the suction nozzle 26 and draws used cleaning liquid through the suction nozzle 26 and the liquid hose 36 to the interior of the dome 32. The used cleaning liquid then falls from the dome 32 into the liquid recovery tank 28.

All of the component parts of the floor cleaning machine 12 discussed above can be found in some form on most other prior art floor cleaning machines. However, the floor cleaning machine 12 is provided with a machine housing 14 having a sleek design configuration that gives the machine 12 a more aesthetically pleasing appearance than prior art cleaning machines.

A part of the aesthetically pleasing appearance of the machine housing 14 is provided by a hood 42 that is connected to the housing 14 for movement of the hood 42 relative to the housing. In the illustrated embodiment, the hood 42 is connected to a top portion of the machine housing 14 by a pivot connection 44. Other equivalent types of connections could also be used. The hood 42 is also provided with an exterior surface 46 having a bottom edge 48 that meets with a top edge 52 of the liquid recovery tank 28 to form a smooth transition between the hood exterior surface 46 and the exterior surface of the liquid recovery tank 28. The hood exterior surface 46 also has a back edge 54 that meets with a front edge 56 of a top portion 58 of the machine housing forming a smooth transition between the hood exterior surface 46 and the exterior surface of the top portion 58 of the machine housing. These contribute to the aesthetically pleasing appearance of the external surfaces of the cleaning machine.

Figure 1:
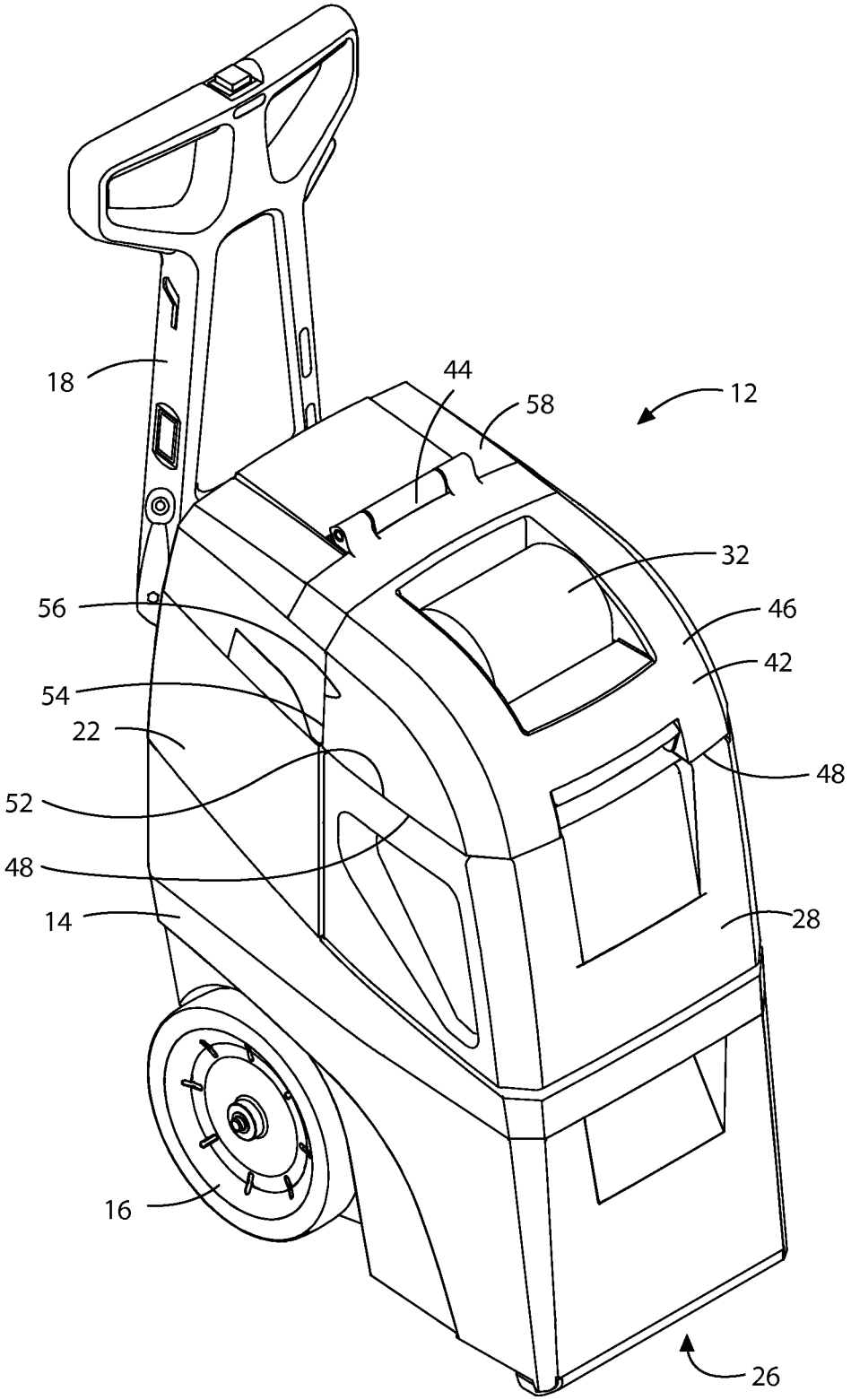
FIG. 1 is a left side perspective view of the floor cleaning machine of the invention.
Figure 2:
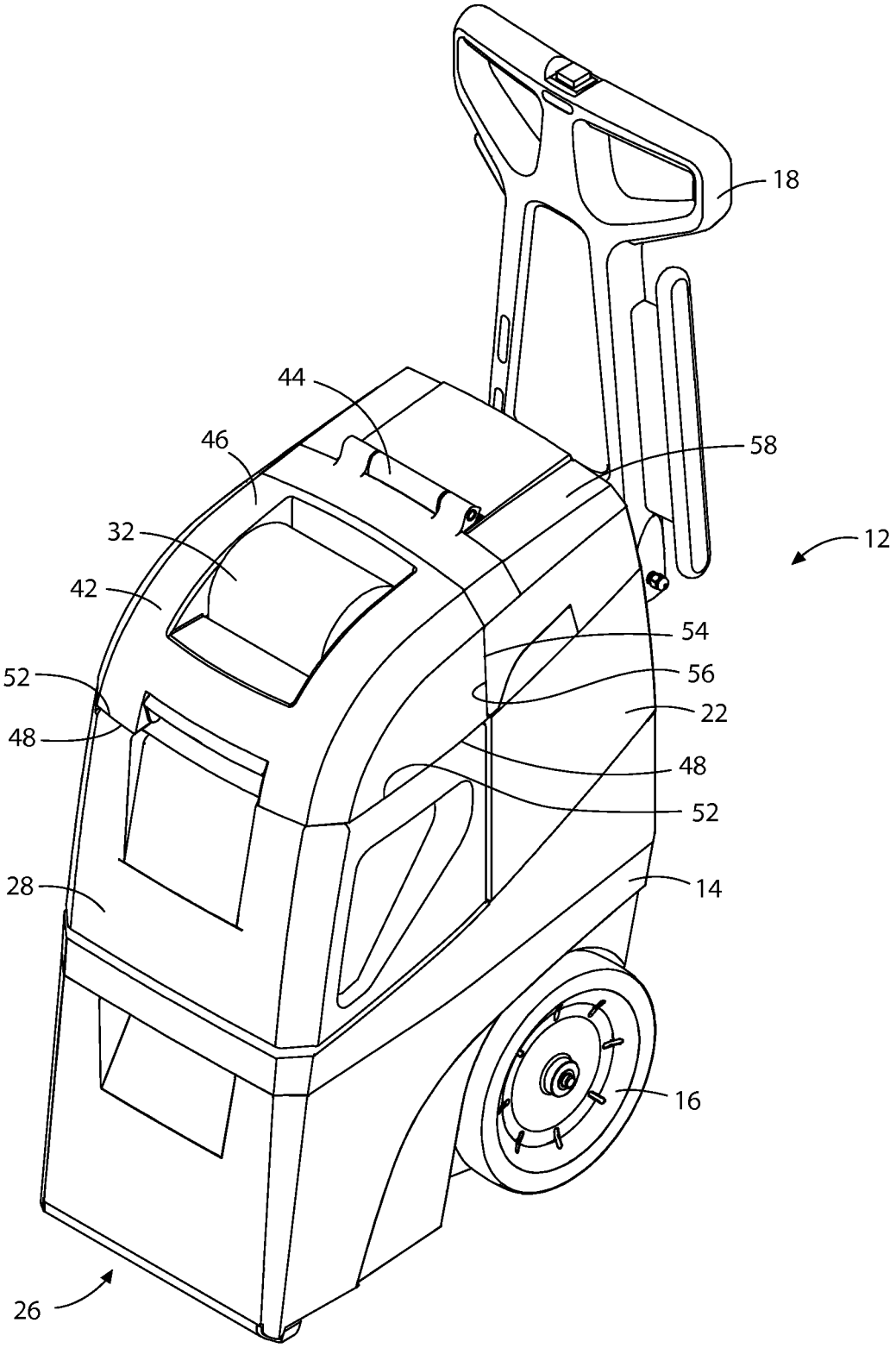
FIG. 2 is a right side perspective view of the floor cleaning machine.
Figure 3:
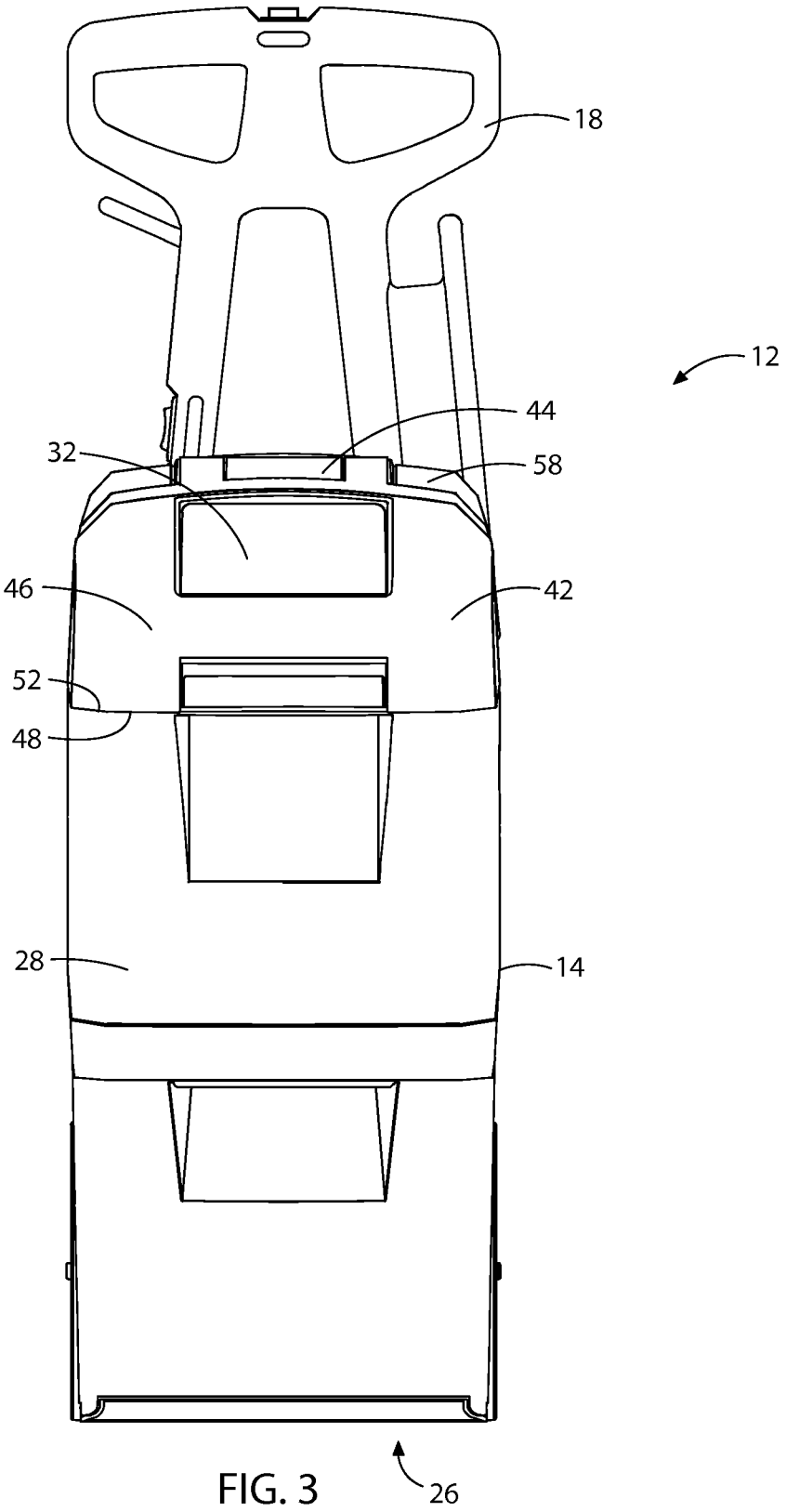
FIG. 3 is a front elevation view of the machine.
Figure 4:
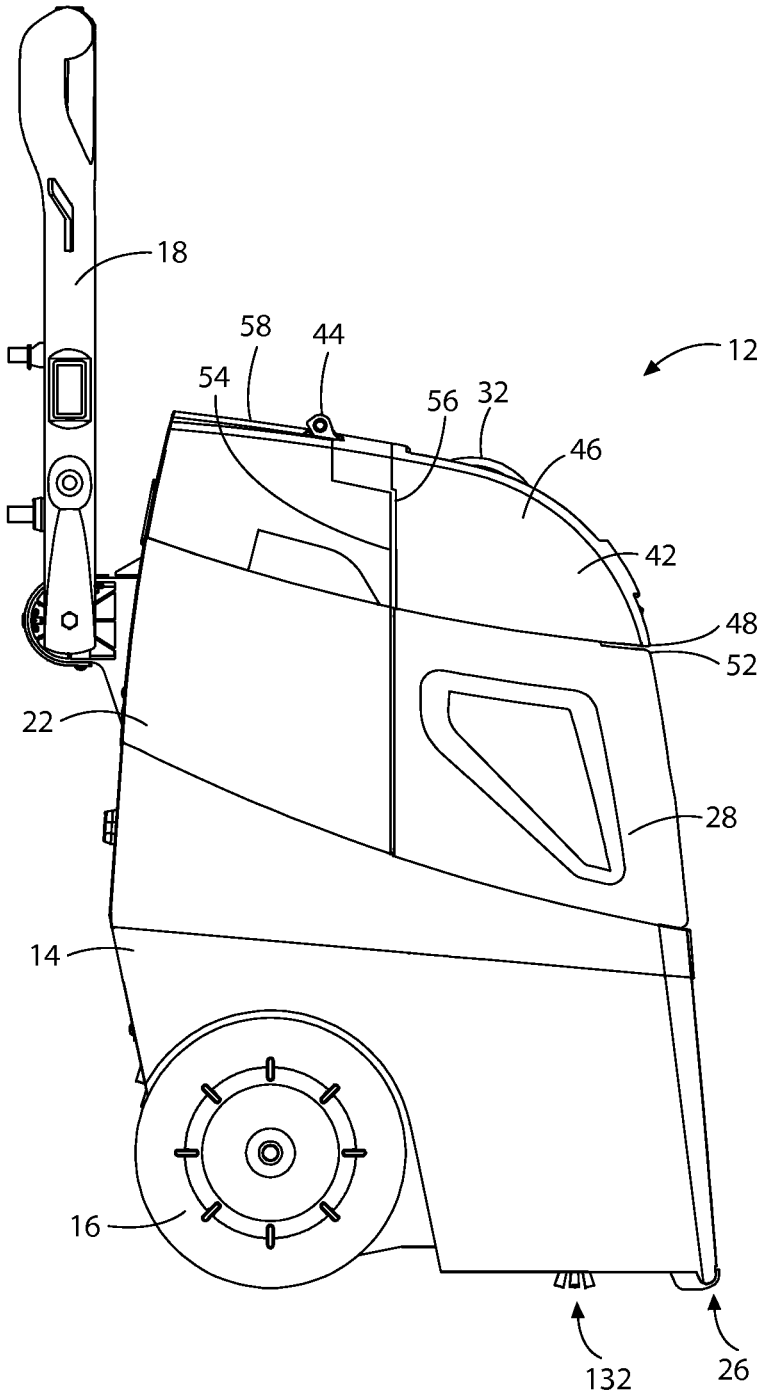
FIG. 4 is a left side elevation view of the machine.
Figure 5:
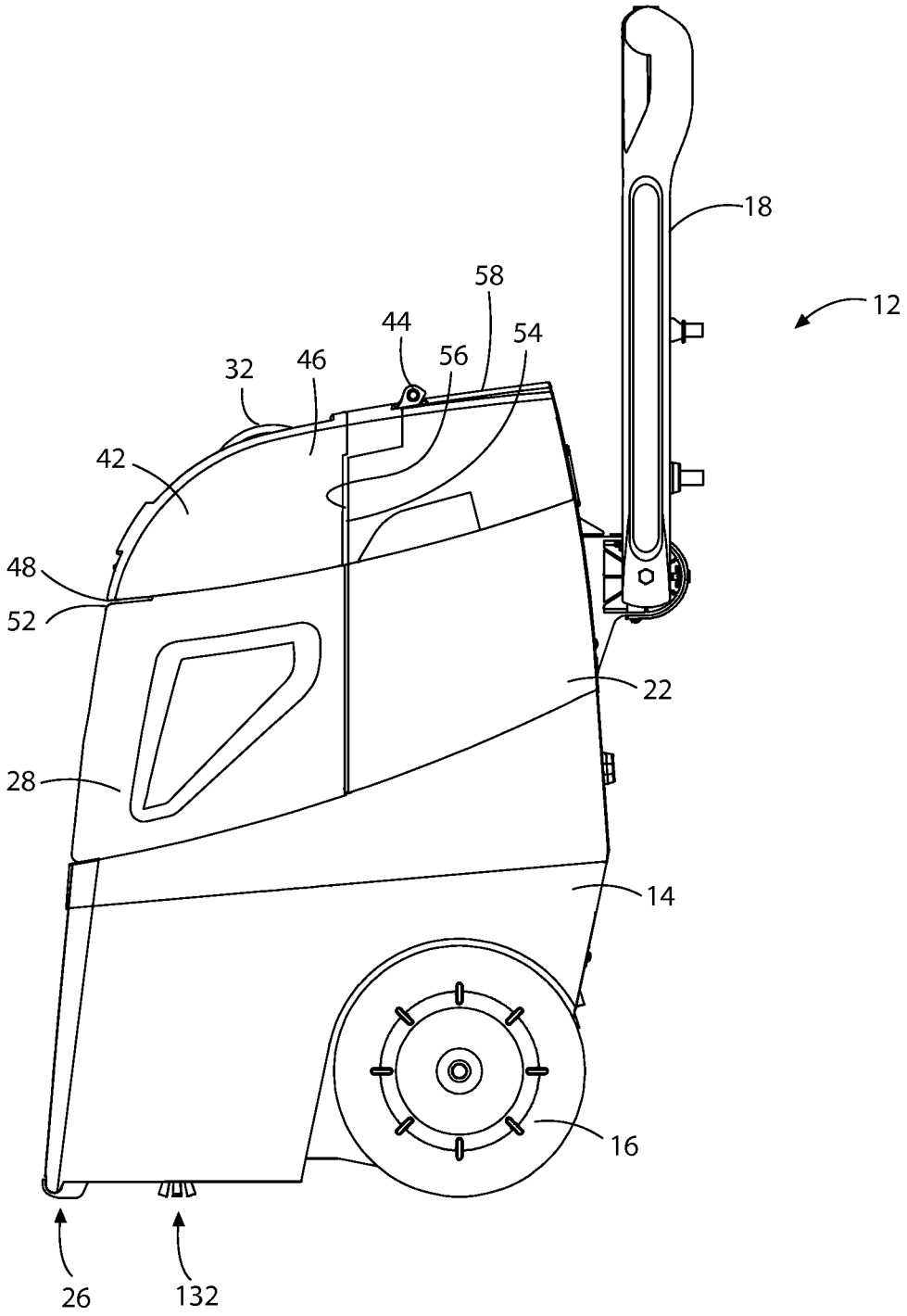
FIG. 5 is a right side elevation view of the machine.
Figure 6:
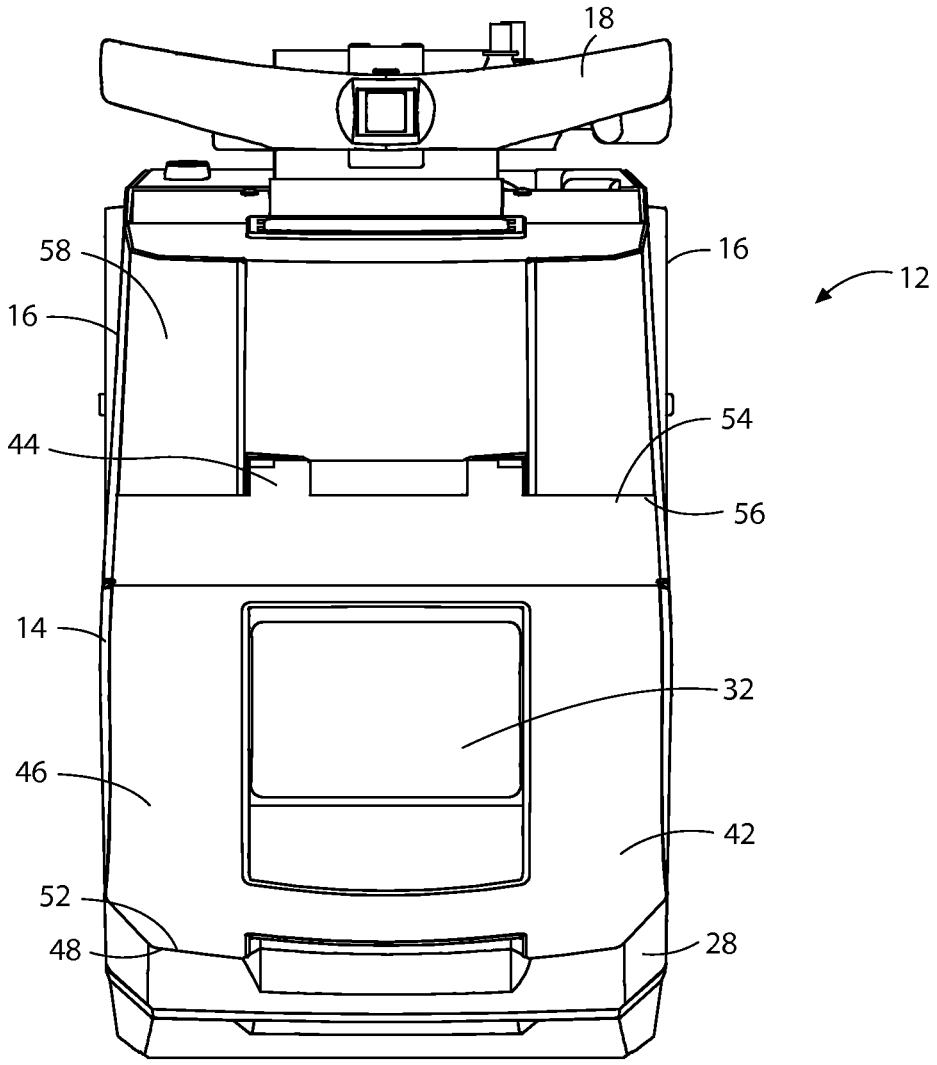
FIG. 6 is a top plan view of the machine.
Figure 7:
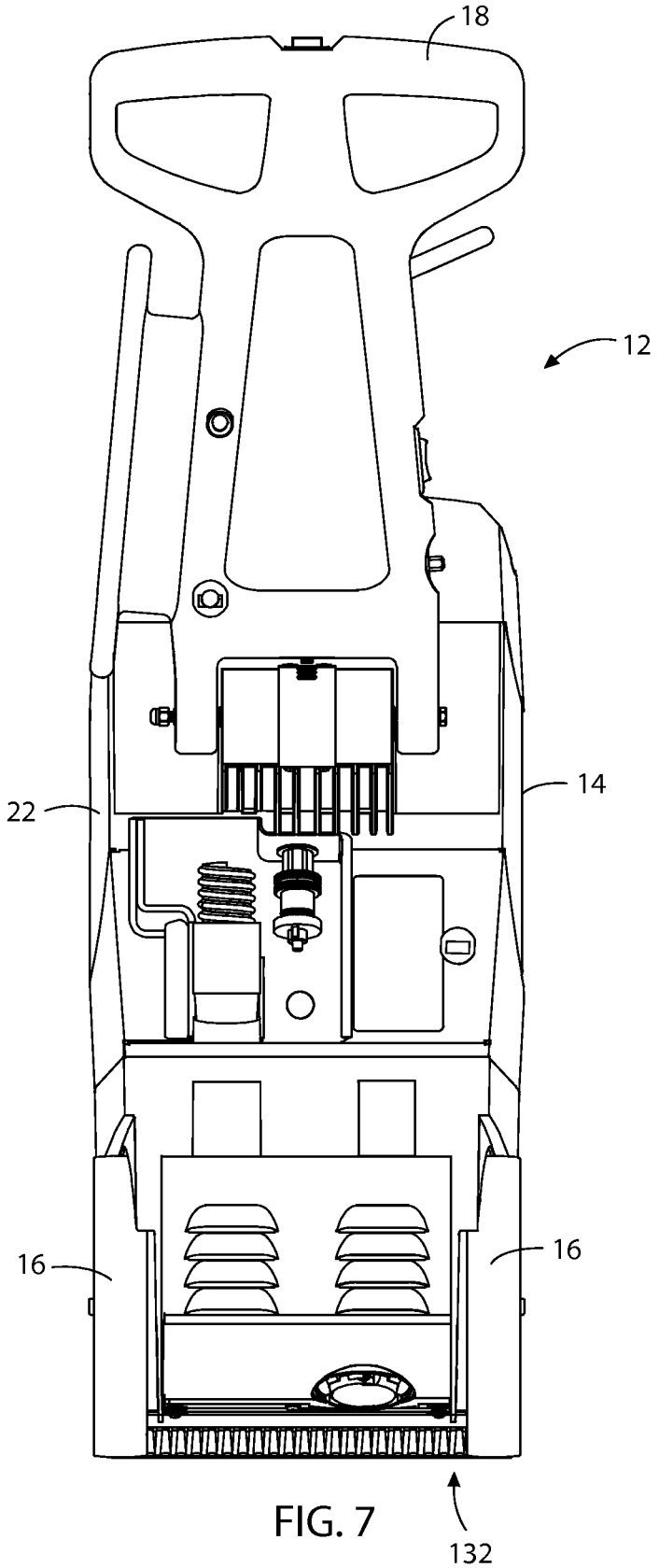
FIG. 7 is a rear elevation view of the machine.
Figure 8:
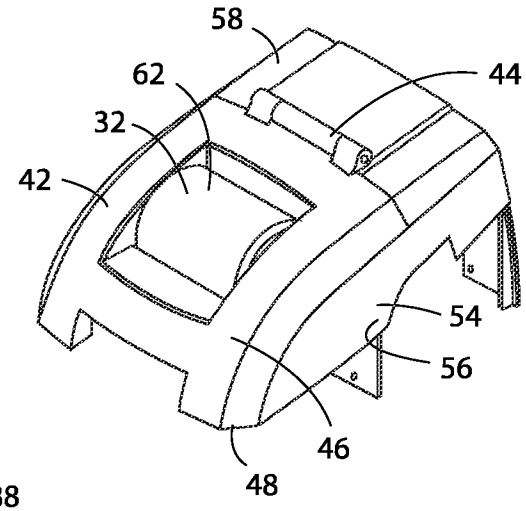
FIG. 8 is a perspective view of a portion of the machine housing removed from the machine and a hood attached to the portion of the machine housing with the hood in an at rest position of the hood relative to the machine housing.
Figure 9:
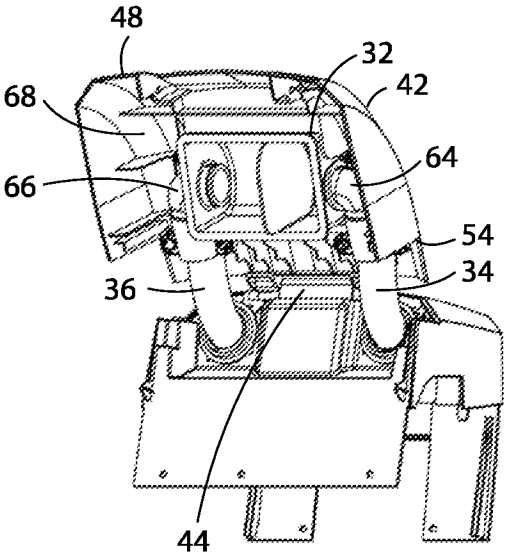
FIG. 9 is a view similar to that of FIG. 8, but showing the hood moved to a displaced position of the hood relative to the machine housing.

The hood 42 is shown in an at rest position of the hood relative to the machine housing 14 in FIGS. 1-7. FIG. 8 shows the hood 42 and the top portion of the machine housing 58 removed from the remainder of the machine. FIG. 9 shows the hood 42 moved to a displaced position of the hood relative to the top portion of the machine housing 58. FIGS. 8 and 9 illustrate that in the at rest position of the hood 42 relative to the machine housing 14, the hood 42 provides the additional function of covering over the vacuum hose 34 and liquid hose 36 from view. Additionally, when the hood 42 is in the at rest position shown in FIG. 8, the hood 42 extends over the top of the liquid recovery tank 28 and the top opening of the liquid recovery tank. When the hood 42 is moved to its displaced position relative to the machine housing 14 shown in FIG. 9, the hood is displaced from the recovery tank 28 enabling the recovery tank to be manually removed from the housing 14 and manually positioned back on the housing.

Figure 10:
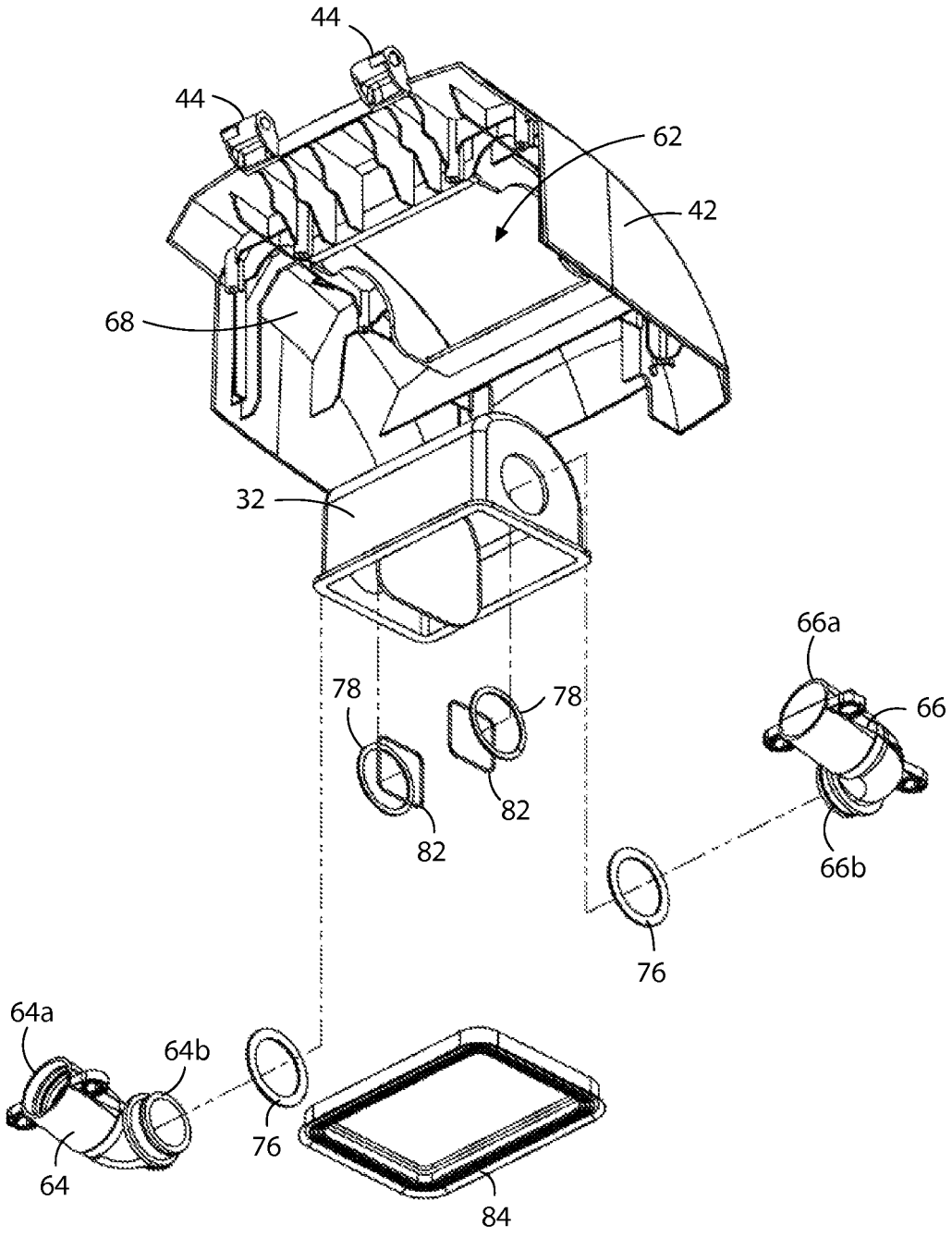
FIG. 10 is a view of the hood removed from the machine housing showing an interior surface of the hood and several component parts of the machine disassembled from the interior surface of the hood.

FIG. 8 also shows the hood 42 having an opening 62 that receives the transparent dome 32 and enables viewing the dome from the exterior of the machine housing 14. FIG. 9 shows the dome 32 being held in position inside the hood opening 62 by a pair of pivot connections 64, 66 that are attached to an interior surface 68 of the hood 42. FIG. 10 shows the first 64 and second 66 pivot connections disassembled from the dome 32 and the hood interior surface 68.

The first pivot connection 64 connects the second end 34*b* of the vacuum hose 34 to the dome 32, and thereby connects the vacuum hose 34 to the hood interior surface 68. The second pivot connection 66 connects the second end 36*b* of the liquid hose 36 to the dome 32, and thereby attaches the liquid hose 36 to the hood interior surface 68.

Each of the first 64 and second 66 pivot connections have tubular lengths with opposite first 64*a*, 66*a* and second 64*b*, 66*b* ends, respectively. The tubular lengths of the first 64 and second 66 pivot connections also have bent or elbow-shaped configurations. This positions the circular second ends 64*b*, 66*b* of the two pivot connections 64, 66 facing each other and in coaxial alignment. The second ends 64*b*, 66*b* of the first and second pivot connections 64, 66 are connected to the opposite ends of the dome 32 to permit pivoting movement of the dome 32 relative to the pivot connections 64, 66 and thereby permit pivoting movement of the dome 32 relative to the hood 42. As shown in FIG. 10, with respect to the first pivoting connection 64, the connection between the first pivoting connection 64 and the dome 32 is provided by an elbow gasket 76 positioned on the first pivot connection second end 64*b* and against the exterior surface of the dome 32, a plastic washer 78 positioned on the second end 64*b* of the first pivot connection 64 and against the interior surface of the dome 32, and a retainer clip 82 positioned on the second end 64*b* of the first pivot connection 64 and against the plastic washer 78. These provide the pivoting connection between the first pivot connection 64 and the dome 32. The second pivot connection 66 is connected to the opposite end of the dome 32 in the same manner.

Figure 18:
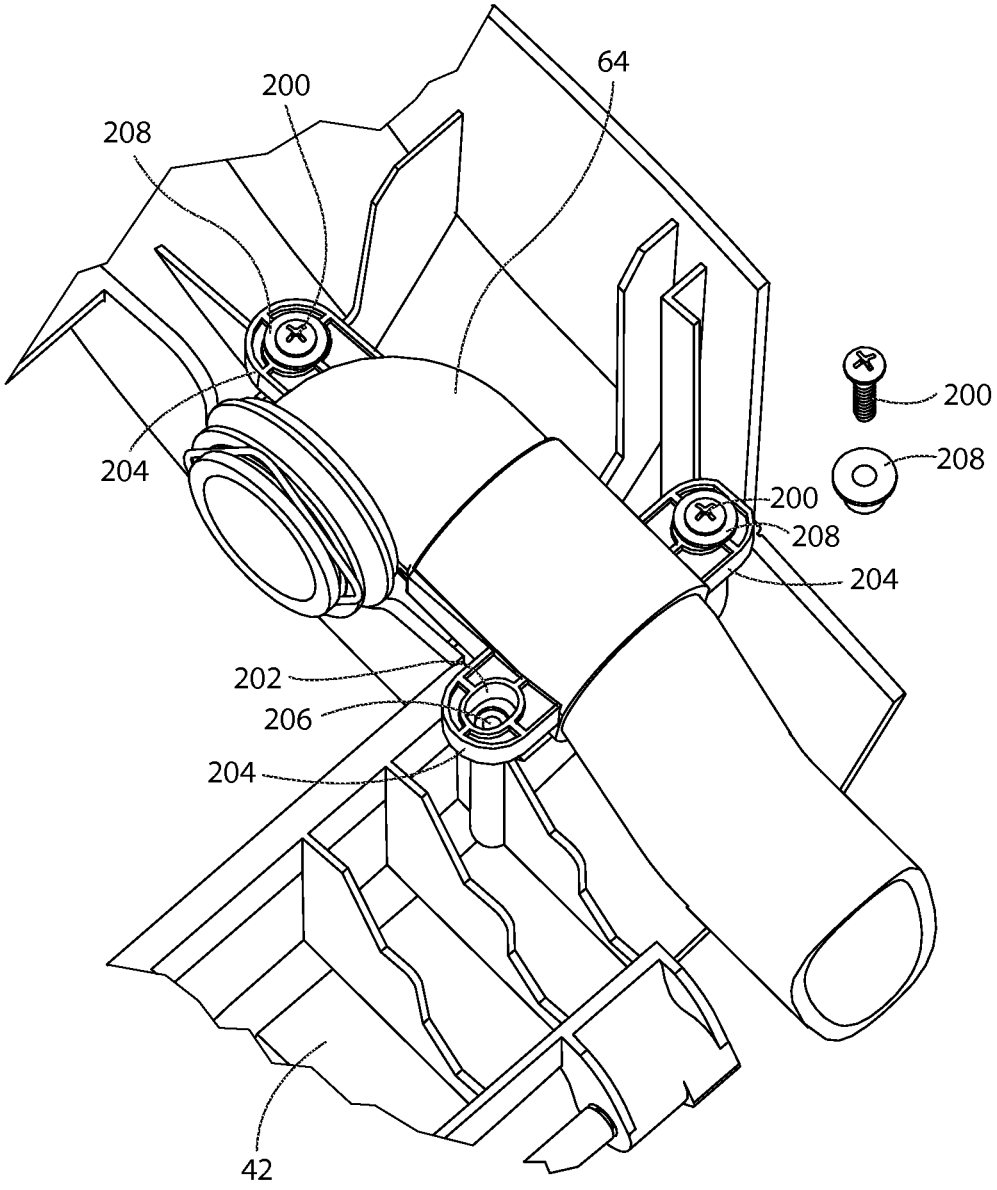
FIG. 18 is a detail view of the connection between the first pivot connection and the hood.

As illustrated in FIG. 18, each of the two pivot connections 64, 66 is preferably attached to the hood 42 in a manner permitting the pivot connection to move side-to-side slightly relative to the housing. This is achieved preferably via screws 200 that pass through slotted openings 202 provided on lugs 204 that are attached to the pivot connections 64, 66. As shown in FIG. 18, the slotted opening 202 of each lug 204 is elongate in a side-to-side direction (i.e., horizontal and parallel to the axis of rotation of the wheels 16 of the cleaning machine 12). Each screw 200 is threaded into a hole 206 that is provided on the hood 42. The screws 200 preferably also pass through collars 208 that are adapted and configured to capture the lugs of the pivot connection 64, 66 with respect to the hood 42 while also preventing the screws from clamping the lugs 204 tightly against the hood. As such, the lugs 204, and therefore the pivot connections 64, 66, are able to slide side-to-side relative to the hood 42. This allows the dome 32 to move side-to-side slightly relative to the hood 42 together with the pivot connections 64, 66 and thereby facilitates proper alignment of the dome with respect to the liquid recovery tank 28 as the hood moves from its displaced position into its rest position. It should be appreciated that, if desired, the openings 202 in the lugs 204 and the screws 200 and collars 208 could be configured to allow the pivot connection 64, 66 and the dome 32 to move slightly front-to-back relative to the hood 42 (i.e., horizontal and perpendicular to the axis of rotation of the wheels 16 of the cleaning machine 12). It should also be appreciated that each screw 200 and collar 208 pair could be formed as a single piece shouldered screw.

FIG. 10 shows a dome gasket 84 that is adhered to a bottom edge of the dome 32. The pivoting movement of the dome 32 relative to the hood 42 provided by the pivot connections 64, 66 allows the gasket 84 to engage in a sealing engagement on the top of the liquid recovery tank 28 around the opening in the liquid recovery tank when the hood 42 is moved to its at rest position. The vacuum pressure generated in the dome 32 when the cleaning machine 12 is operated pulls the dome 32 down onto the top of the liquid recovery tank 28, enhancing the sealing engagement of the gasket 84 on the top of the tank.

Figure 11:
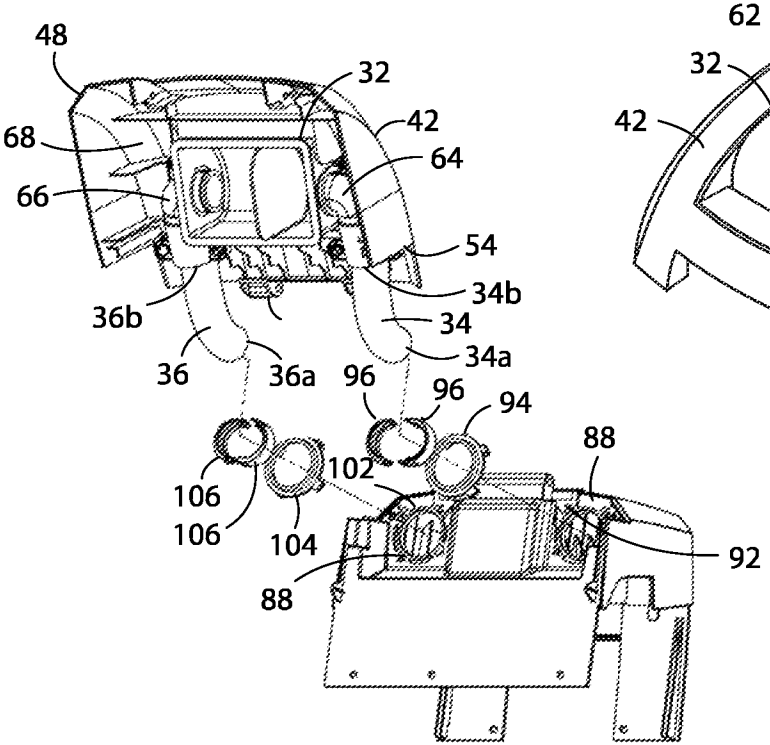
FIG. 11 is a view similar to that of FIG. 9, but showing the hood disassembled from the machine housing.

FIG. 11 illustrates the connection of the vacuum hose first end 34*a* to a wall 88 on the machine housing top portion and the connection of the liquid hose first end 36*a* to the wall 88 of the machine housing top portion. The connections of the hoses 34, 36 to the machine housing wall 88 are basically provided by ball and socket connections that enable the movement of the vacuum hose first end 34*a* and the liquid hose first end 36*a* relative to the housing wall 88.

The first ball and socket connection is comprised of a first portion of a socket surface 92 formed around an opening through the wall 88 of the housing top portion. The first portion of the socket surface 92 is circular as it extends around the opening through the housing wall 88, and is generally concave as it extends radially outwardly from the opening in the wall 88. A first socket ring 94 snaps onto the housing wall 88 over the first portion of the socket surface 92. The first socket ring 94 has a portion of a socket surface that is circular as it extends around the ring and is generally concave radially of the ring. The portion of the socket surface on the first socket ring 94 opposes the first portion of the socket surface 92 on the machine wall 88 when the first socket ring is snapped onto the wall.

A first ball ring 96 is attached on the vacuum hose first end 34*a*. The first ball ring 96 is shown in two parts in the drawing figures. These two parts can be secured together around the vacuum hose first end 34*a* by threaded fasteners, by adhesives, or by other equivalent means. The first socket ring 94 secured to the vacuum hose first end 34*a* has a convex exterior surface. The first ball ring 96 is sandwiched between the first portion of the socket surface 92 on the housing wall 88 and the first socket ring 94 with the convex exterior surface of the first ball ring 96 engaging in sliding engagement with the concave socket surfaces of the first portion of the socket surface 92 on the housing wall 88 and the first socket ring 94. This provides the ball and socket connection between the vacuum hose first end 34*a* and the machine housing top portion 58.

A second ball and socket connection between the liquid hose first end 36*a* and the machine housing top portion wall 88 is provided in the same manner as the first ball and socket connection described above. The second ball and socket connection is comprised of a second portion of a socket surface 102 on the machine housing top portion wall 88. In addition, the second ball and socket connection comprises a second socket ring 104 and a second ball ring 96 that are assembled together in the same manner as the first ball and socket connection described above. In this manner, the liquid hose first end 36*a* is connected by a ball and socket connection with the machine housing top portion 58.

The first and second pivot connections 64, 66 and the first and second ball and socket connections described above reduce the stresses on the vacuum hose 34 and the liquid hose 36 as the hood 42 is moved between its at rest position and its displaced position relative to the machine housing 14.

The floor cleaning machine 12 of the present invention also has a pair of spray tips 114, 116 on the bottom of the machine 12 that are designed to avoid spray interference between the tips. The spray tips 114, 116 and their positions on the bottom of the machine 12 are shown in FIG. 12. As seen in FIG. 12, each of the spray tips 114, 116 has a slit orifice 118, 122 that ejects a fan spray pattern of cleaning liquid from each orifice 118, 122. The spray tips 114, 116 are located at staggered positions on the bottom of the machine 12 with a first spray tip 114 positioned closer to the front of the machine and a second spray tip 116 positioned closer to the rear of the machine. The two spray tip orifices 118, 122 are positioned so that their slit configurations are parallel to each other and are generally parallel to the front of the machine and the rear of the machine. Additionally, due to their staggered locations, the two slit orifices 118, 122 are positioned in generally vertically oriented planes that are parallel to each other but are not coplanar. This allows the fan spray pattern of cleaning liquid ejected from each of the slit orifices 118, 122 to overlap each other without interfering with each other. In the preferred embodiment, the fan spray patterns ejected by the slit orifices 118, 122 only partially overlap to maximize the coverage of the two spray patterns. Stated differently, substantial portions of the two spray patterns or majorities of the two fan spray patterns ejected by the slit orifices 118, 122 do not overlap.

FIGS. 14 through 17 show the oscillating brush assembly 132 of the cleaning machine of the invention 12. The brush assembly 132 is basically comprised of a brush base 134, an adjustment plate 136 and a brush 138.

The brush base 134 has an elongate length with coaxial pivot pins 142 at opposite ends of the base length. The pivot pins 142 are mounted to the bottom of the machine 12 in a conventional manner. The brush base 134 moves in oscillating movements about the pivot pins 142 in operation of the brush assembly 132. A crank arm 144 projects from one side of the brush base 134. The crank arm 144 is connected to a drive mechanism of the machine 12 that drives the brush base 134 in oscillating movements about the pivot pins 142. Any known type of drive mechanism could be employed for this purpose. A pair of locator edges 146 project from an opposite side of the brush base from the crank arm 144. The locator edges 146 are employed in positively locating the brush 138 along the length of the brush base 134 when the brush 138 is attached to the brush base 134. A pair of elongate slots 148 are provided through the brush base 134. The lengths of the slots 134 are parallel to each other and are basically perpendicular to a common axis of the brush base pivot pins 142.

The adjustment plate 136 is removably attachable by mechanical fasteners to the brush base 134 and is adjustably positionable on the brush base 34. The adjustment plate 136 has an elongate length that is dimensioned to fit within the locator edges 146 of the brush base 134. This dimensioning of the adjustment plate 136 allows the adjustment plate to slide between the locator edges 146 in directions toward and away from the brush base pivot pins 142, but prevents any movement of the adjustment plate 136 along the common axis of the brush base pivot pins 142. The adjustment plate 136 has a pair of cylindrical posts 148 that are positioned on the adjustment plate 136 so that they coincide with the pair of slots 148 on the brush base 134. The cylindrical posts 152 have holes 154 that extend through the posts 152 and the adjustment plate 136. The holes 154 align with the slots 148 through the brush base 134. The adjustment plate 136 also has a plurality of locator tabs 156 that project outwardly from the same side as the adjustment plate 136 as the cylindrical posts 152. Each of the locator tabs 156 has a locating surface 158 at the bottom of the tab. The locating surfaces 158 of the tabs 156 positively locate the brush 138 relative to the brush base 134 and the adjustment plate 136 when the brush is attached to the brush assembly 132.

Mechanical fasteners secure the adjustment plate 136 to the brush base 134 for adjusting movement of the adjustment plate 136 relative to the brush base 134. In the illustrated embodiment, the mechanical fasteners are pairs of screws 162 and nuts 164. Other equivalent types of mechanical fasteners could be employed. The screws 162 extend through the slots 148 in the brush base 134 and through the holes 154 through the adjustment plate 136 and are screw threaded into the nuts 164. The extent of movement of the screws 162 through the brush base slots 148 defines the adjustable movement of the adjustment plate 136 relative to the brush base 134. When the adjustment plate 136 is in a desired adjusted position relative to the brush base 134, the screws 162 are tightened down in the nuts 164, thereby securing the adjustment plate 136 in its adjusted position to the brush base 134. The adjustment plate posts 152 space the adjustment plate 136 at a fixed distance from the base 134 to accommodate the brush 138 between the adjustment plate 136 and base 134.

The brush 138 is attachable to the brush base 134 and the adjustment plate 136, and is removable from the brush base 134 and the adjustment plate 136 without the use of tools. The brush 138 can be manually snap fit onto the brush base 134 and the adjustment plate 136, and manually pulled from the brush base 134 and the adjustment plate 136. The brush 138 is designed to be easily removable from the brush assembly 132 when it is desired to replace a worn brush, or it is desired to replace one type of brush designed for cleaning a particular floor surface with another type of brush designed to clean another type of floor surface.

The brush 138 has a center portion or a handle portion 172 with opposite top 174 and bottom 176 surfaces. A plurality of bristles 178 project outwardly from the brush bottom surface 176. A clip assembly 182 projects outwardly from the brush top surface 174. The clip assembly 182 removably attaches the brush 138 to the brush base 134 and the adjustment plate 136 without the use of tools.

The clip assembly 182 includes a pair of keys 184 at the opposite ends of the clip assembly. The keys 184 are spaced a distance apart from each other where the keys will engage in sliding engagement against the locator edges 186 of the brush base 134 as the brush 138 is removably attached to the brush base 134 and the adjustment plate 136. The engagement of the brush clip assembly keys 184 with the brush base locator edges 146 prevents the brush 134 from moving side to side along the common axis of the brush base pivot pins 142 when the brush 134 is attached to the brush base 134 and the adjustment plate 136.

The brush clip assembly 182 also includes a plurality of resilient snap-in fingers 186. The number of snap-in fingers 186 on the brush 138 corresponds with the number of locator tabs 156 on the adjustment plate 136. Each of the snap-in fingers 186 has a resilient shank 188 that projects from the brush top surface 174 and an enlarged head 192 at the distal end of the shank 188. Referring to FIG. 17, when the brush 138 is being attached to the brush base 134 and the adjustment plate 136, the clip assembly keys 184 are positioned between the locator edges 146 of the brush base 134. The brush 138 is then manually pushed toward the brush base 134 and the adjustment plate 136, causing the clip assembly fingers 186, and in particular the finger heads 192 to engage in sliding engagement along the sides of the locator tabs 156 on the adjustment plate 136. As the brush 138 is continuing to be pushed onto the brush base 134 and the adjustment plate 136, the sliding engagement of the snap-in finger heads 192 against the locator tabs 156 causes the resilient shanks 188 of the snap-in fingers 186 to bend away from the locator tab 156 engaged by the snap-in finger. As the brush 138 is continued to be pushed onto the brush base 134 and the adjustment plate 136, the locating surfaces 158 of the locator tabs 156 engage against a stop surface 194 of the brush clip assembly 182 preventing further movement of the brush 138 toward the brush base 134 and the adjustment plate 136. Substantially simultaneously, the resilient shank 188 of the snap-in fingers 186 cause the finger heads 192 to snap over the opposite ends of the locator tabs 156 from the tab locating surfaces 158. This securely attaches the brush 138 to the adjustment plate 136 in the adjusted position of the adjustment plate 136 on the brush base 134, and thereby securely attaches the brush 138 to the brush base 134 and the adjustment plate 136 without the use of tools.

To remove the brush 138 from the brush base 134 and the adjustment plate 136, the brush 138 is manually pulled from the brush base 134 and the adjustment plate 136 with a sufficient force to cause the shanks 188 of the snap-in fingers 186 to flex away from their engaging locator tabs 156, thereby releasing the brush 138 from the brush base 134 and the adjustment plate 136.

In view of the foregoing, it will be seen that the several advantages of the invention are achieved and attained.

As various modifications could be made in the constructions herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A floor cleaning machine that is adapted and configured to be placed on a floor, the floor cleaning machine comprising:

a housing;

at least one pair of wheels mounted to the housing that are adapted and configured to support at least a portion of the housing above such a floor;

a handle on the housing that is configured and adapted to permit a person to control the movement of the housing relative to such a floor;

a brush base mounted on a bottom of the housing and being configured and adapted to oscillate relative to the housing;

an adjustment member mounted on and supported by the brush base such that the adjustment member is configured to oscillate with brush base, the adjustment member being movable between a raised position of the adjustment member relative to the brush base and a lowered position of the adjustment member relative to the brush base; and, a brush removably attached to the adjustment member, the brush having a handle, a plurality of bristles that project outwardly from the handle, and at least one clip that is connected to the handle, the clip being snap fit to the adjustment member and thereby removably attaching the brush to the adjustment member.

2. A floor cleaning machine in accordance with claim 1 wherein the adjustment member has at least one locating surface on the adjustment member that is engaged by the brush clip when the brush is removably attached to the adjustment member and thereby positively locates the brush on the adjustment member.

3. A floor cleaning machine in accordance with claim 1 wherein the floor cleaning machine comprises a fastener assembly on the brush base and the adjustment member that is manually actuatable to lock the adjustment member in an adjusted position to the brush base.

4. A floor cleaning machine in accordance with claim 3 wherein the fastener assembly comprises mating internal and external screw threads.

5. A floor cleaning machine in accordance with claim 1 wherein one of the brush base and the adjustment member has a slot hole therethrough and the other of the brush base and adjustment member has a hole that aligns with the slot hole as the adjustment member is moved between the raised position and the lowered position relative to the brush base.

* * * * *